US005865045A

United States Patent [19]

Wagner et al.

[11] Patent Number: 5,865,045

[45] Date of Patent: Feb. 2, 1999

[54] KNIT WEAVE TARPAULIN CONSTRUCTION

[76] Inventors: J. Edward Wagner, 3739 Skipview La., Collegeville, Pa. 19426; Jaime Peisach, Barrera 95 #24-49, Bogota, Colombia

[21] Appl. No.: 832,268

[22] Filed: Apr. 3, 1997

[51] Int. Cl.[6] ..... D04B 1/00; D04B 21/00; D03D 3/00

[52] U.S. Cl. ..... 66/170; 66/195; 428/229

[58] Field of Search ..... 66/195, 170; 428/229

[56] References Cited

U.S. PATENT DOCUMENTS 4,279,134 7/1981 Matsuda ..... 66/195
5,339,657 8/1994 McMurray ..... 66/195
5,461,885 10/1995 Yokoyama et al. ..... 66/170
5,545,470 8/1996 Schuster et al. ..... 428/229

*Primary Examiner*—Johann Richter
*Assistant Examiner*—Joseph Murray
*Attorney, Agent, or Firm*—Schweitzer Cornman Gross & Bondell LLP

[57] ABSTRACT

A containment tarpaulin is formed of an open weave knit stretch fabric having a major pore size which provides sufficient porosity to prevent lift of the tarpaulin due to airfoil effects. The open weave construction, particularly when polyester yarns are utilized, additionally provides resistance to tears, punctures, and abrasion. A rip-stop construction, preferably in the form of solid fabric areas extending across the width and length of the fabric, may be added to improve the strength of the fabric.

12 Claims, 3 Drawing Sheets

KNIT WEAVE TARPAULIN CONSTRUCTION

The present invention relates to an improved fabric having significant utility as a tarpaulin-type product that offers ease of handling during installation and resistance to tearing, puncturing or rupturing when used.

BACKGROUND OF THE INVENTION

Containment tarpaulins are used to cover the beds of trucks, rail cars, barges and the like when transporting loads subject to dispersal during transport, such as the transport of trash to a disposal area such as a land fill or trash plant, in order to prevent the load from flying from the vehicle and thereby contaminating the surrounding area. Containment is also of concern when the load is of value, or when dispersal of the load could cause injury, such as when gravel is transported. Fast moving vehicles such as trucks are especially prone to release of the transported material as a result of high velocity air currents generated by the moving vehicle. A tarpaulin to cover a load must be of a size sufficient both to fully overlie the load and provide peripheral area for the tie down. Truck trailers are generally about 16 meters long and 2.4 meters wide and thus containment fabric is made oversized for such a trailer, the fabric might be 17.4 meters long and 4 meters wide.

In addition to load containment, tarpaulin-type constructions are used for other protective purposes, and as wrappings and coverings.

The prior art teaches the use of canvas, a tightly woven fabric, usually in a plain weave construction, for tarpaulin use. The weave construction utilized makes the fabric relatively costly to manufacture. In addition, being formed of large diameter warp and filling yarns, canvas is stiff, heavy and therefore often difficult to manipulate and cover the load contained in the vehicle. Often, because of the weight, more than one individual is required to put the canvas in place and tie it down. In addition, canvas has low stretch and is easily punctured by sharp articles. And, because canvas has a low permeability, canvas tends to lift from the load due to the airfoil created by a mound of load and the passing air current developed by the velocity of the vehicle. The lift and inflation of the tarpaulin creates a larger cross-sectional area which creates additional drag and therefore increased fuel consumption for the vehicle.

To overcome the high weight of canvas, loosely woven nonstretch filament yarn plain weave containment fabrics have been used. Such fabrics may be coated with resins, such as phenolics or urea formaldehydes, in an attempt to give stability to the loosely woven structure. Formaldehyde, however, is a known carcinogen and such treatment can pollute the atmosphere. There is also concern regarding the use of such treated fabrics. While light in weight, these containment fabrics are stiff and therefore difficult to handle. The nonstretch filament yarns, especially after coating, are especially resistant to stretching. As a result the containment tarpaulin often cannot be fitted tightly against the load, allowing the load to shift against the fabric, subjecting it to cuts, tears and punctures. Being of a coarse mesh count, once the fabrics are damaged they cannot easily be patched or otherwise repaired.

It is accordingly a purpose of the present invention to provide a tarpaulin-type fabric which is of light weight and rugged design.

A further purpose of the present invention is to provide a tarpaulin-type fabric having the capability to conform to the shape of a load about which it is placed.

Still a further purpose of the present invention is to provide a tarpaulin-type fabric which exhibits stretch and which has sufficient air permeability to prevent the generation of lift forces.

BRIEF DESCRIPTION OF THE INVENTION

In accordance with the foregoing and other objects and purposes, a tarpaulin fabric in accordance with the present invention comprises a knit weave of a stretch yarn. The fabric includes major pores or interstices of about at least 0.25 square millimeters. A preferred yarn material may be polyester. In addition to use as a tarpaulin, the fabric may have utility as a protective screen, as a net fabric for soccer goals and the like; and in other uses where a strong, flexible and air-permeable fabric is required.

BRIEF DESCRIPTION OF THE DRAWINGS

A fuller understanding of the present invention and the features and benefits thereof will be achieved upon consideration of the following detailed description of a preferred embodiment of the invention when reviewed in connection with the annexed drawings, wherein.

DETAILED DESCRIPTION OF THE INVENTION

The fabric of the present invention preferably incorporates a looped structure of a knitted fabric preferably formed from a stretch yarn. The knit construction utilized may be a warp knit, a weft knit, or a stitch-through fabric construction having laid-in weft yarns, all as known in the art. The stretch yarns utilized may be produced by any of the known methods of producing such yarns, such as knife edge curling; twist, heatset, untwist processes; knit de-knit methods; stiffer box; bicomponent fiber and yarn; slack mercerization; or other methods for incorporating a stretch capability beyond that ordinarily found in filament, ring spun, up-twisted or down-twisted yarns.

It is generally contemplated that texturized polyester yarns, of about 150 denier be employed, although additional components, such as Spandex fiber in percentages up to 5 percent or more, may be incorporated in an appropriate yarn to achieve appropriate stretch. Such stretch assists in resisting inflation and minimizes puncturing or cutting.

To further reduce the tendency of the fabric to inflate or rise, particularly from vehicle velocity effects, the fabric or weave should have major pores or interstices of at least about 0.25 square millimeters in area in the relaxed, unstretched state. Preferably, the interstices should be subject to increase up to about 5 square millimeters in area when placed in tension, with full recovery to the unstretched state. As used herein, the term "major pore or interstice" is intended to refer to average of the largest set of pores or interstices as seen when the fabric is viewed in plan and which is surrounded by yarns, and not the area between individual yarn fibers.

Figure 1:
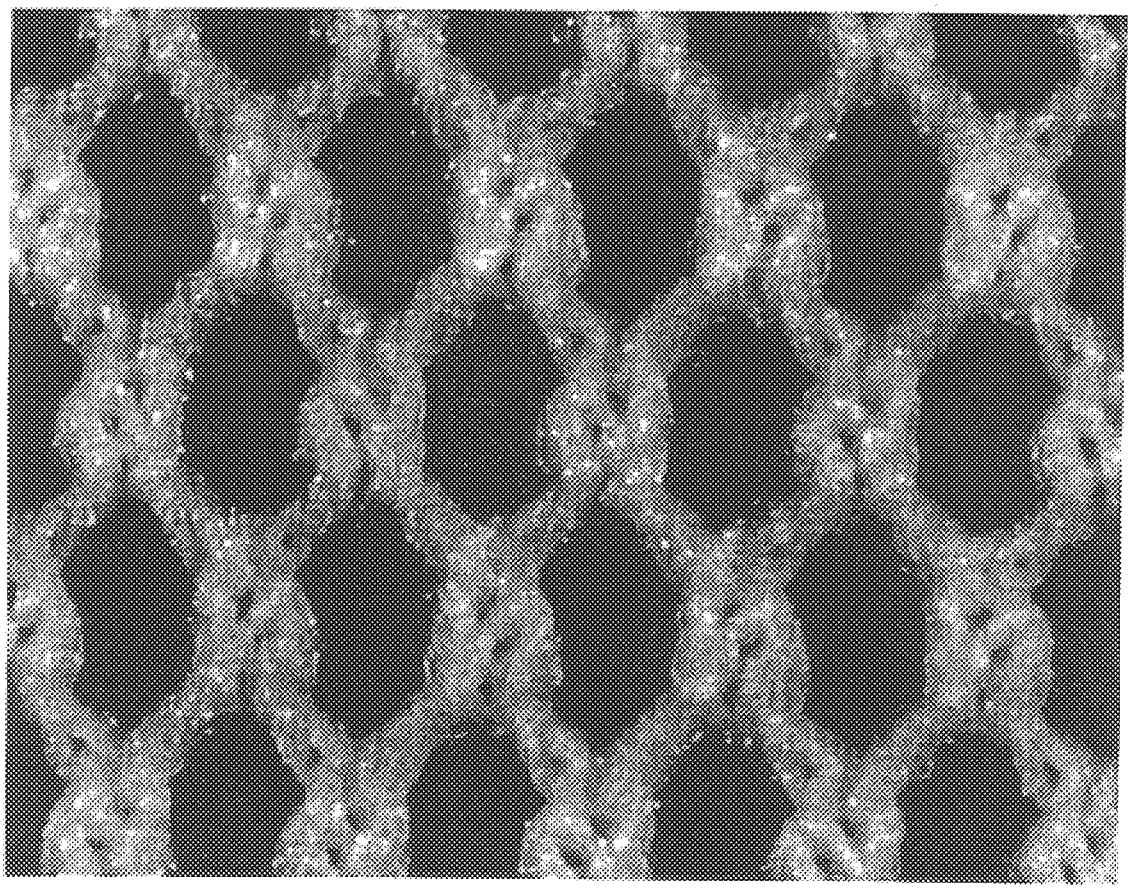
FIG. 1 is a photomicrograph of a section of a weave of a tarpaulin-type fabric constructed in accordance with the present invention.

FIG. 1 is a photomicrograph of a tricot knit weave tarpaulin fabric of the present invention with the fabric in a slack or untensioned condition. The major pores or interstices, as shown by the dark areas in the photomicrograph, are apparent. With such a construction, the fabric has a high air permeability and the containment tarpaulin has a substantially decreased tendency to rise and inflate over lower permeability fabrics. In its relaxed condition the fabric has a basis weight of about 221 grams per square meter. Analysis of 5 of the major pores, chosen at random, the average area was 0.7928 square millimeter, with a standard deviation of 0.09094 square millimeter with a percent coefficient of variation of 11.47 percent.

Figure 2:
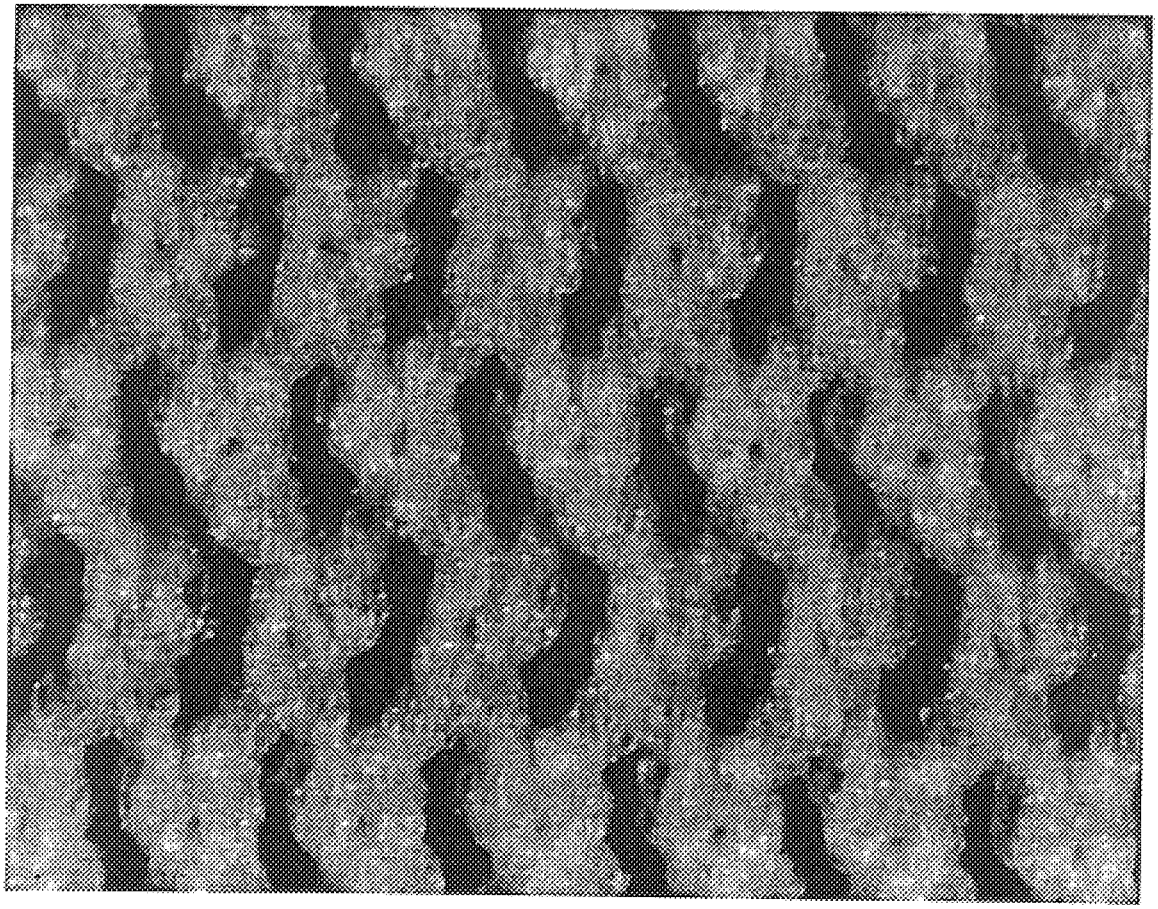
FIG. 2 is a photomicrograph of a section of the fabric weave of FIG. 1 in a stretched configuration.

FIG. 2 illustrates the knitted tarpaulin fabric of FIG. 1 stretched in width and height to illustrate the high degree of stretch capable of being obtained. In relative terms such available stretch should be preferably at least 15% of width and/or height, with full return to the original size. The fabric shown has been measured to accommodate a 74% width and 44% height increase. In the stretched state the average fabric major pore area was 2.838 square millimeters with a standard deviation of 0.08758 square millimeters and a percent coefficient of variation of 3.08 percent.

While either staple or continuous filament yarns, in either a singles or ply yarn construction may be utilized, a preferred yarn is a singles filament yarn formed into a stretch yarn by the twist, heatset, untwist method. The yarn denier in the fully stretched condition may range from between 70 to 4000 denier. Polyester fiber is preferred, as it is easily heatset and has excellent ultraviolet and sunlight resistance.

Figure 3:
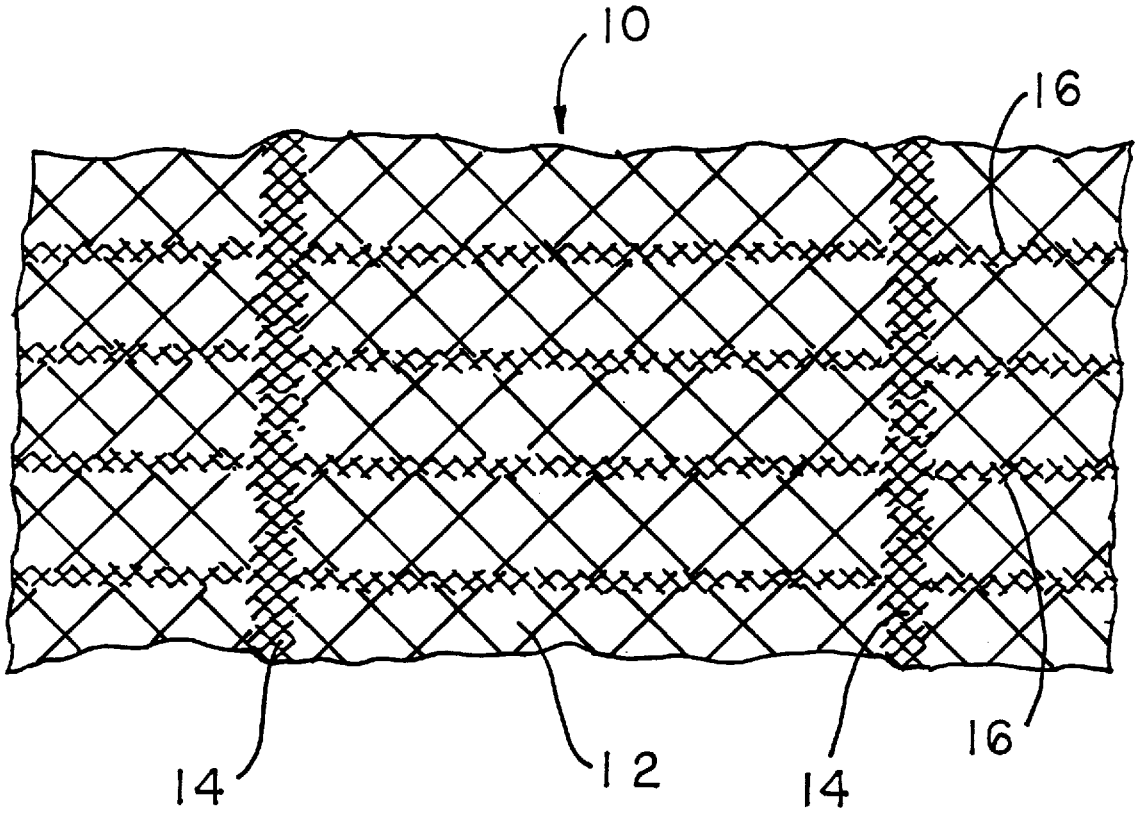
FIG. 3 is a diagrammatic plan view of a portion of a tarpaulin incorporating the fabric depicted in FIGS. 1 and 2.

To further improve the tear, cutting and puncturing resistance of the fabric, the fabric may be construction in a rip-stop manner. As depicted in FIG. 3, the fabric as depicted in FIGS. 1 and 2 may include rip-stop cells on a scale of approximately 80×18 millimeters. The rip-stop feature can be produced through methodology known in the art, such as by placing more yarns of the same size side-by-side, using larger denier yarns, or by having a tighter knit, weave, or knotting arrangement at the desired locations. As shown in FIG. 3, the open mesh cell portions 12 of the tarpaulin fabric 10 may be 3 inches wide, followed and divided by ¼ inch sections or walls 14 of tightly woven fabric. The open mesh is further lapped every 28 courses (about ⅝ inches) with a wall of 4–6 courses (about ⅛ inch) of closed non-mesh fabric 16.

Such a fabric weave may be achieved through a 2 bar tricot warp kit construction with the front bar set as follows: 3(1-0/1-2/1-0/1-2/2-3/2-1/2-3/2-1/)1-0/1-2/1-0/1-2/2-3/2-1/1-0/1-2/2-3/2-1)1-0/1-2/2-3/2-1/ and the back bar set as follows: 3(2-3/2-1/2-3/2-1/1-0/1-2/1-0/1-2) 2-3/2-1/2-3/2-1/1-0/1-2/2-3/2-1/1-0/1-2/

It is to be recognized by those skilled in the art that adaptations, modifications and variations from the specific embodiment described herein without departing from the spirit or scope of the invention, which is as reflected in the claims herein.

We claim:

1. A tarpaulin-type fabric comprising a knit weave of stretch non-metallic fabric having a weave major pore area of at least about 0.25 square millimeters.

2. The fabric of claim 1, wherein said fabric is formed from a polyester yarn.

3. The fabric of claim 1, wherein said fabric is formed from a stretch yarn.

4. The fabric of claim 3, wherein the stretch yarn comprises at least 5 percent spandex fiber.

5. The fabric of claim 1, wherein said fabric includes rip-stop elements therein.

6. The fabric of claim 5, wherein said rip-stop elements comprise open weave cells bounded by closed fabric walls, said cells extending substantially across the width and length of the fabric.

7. The fabric of claim 6, wherein said cells are rectangular and are about 80 millimeters in length and 18 millimeters in width.

8. A stretchable non-metallic knit weave tarpaulin type fabric having major pore areas in a relaxed state of about 0.25 square millimeters on average and major pore areas in a tensioned state which do not exceed about 5.0 square millimeters on average.

9. The fabric of claim 8, wherein said fabric can accommodate a widthwise increase of about 74%.

10. The fabric of claim 9, wherein said fabric can accommodate a lengthwise increase of about 44%.

11. The fabric of claim 10, wherein said fabric can accommodate a widthwise increase of about 74%.

12. A stretchable non-metallic knit weave tarpaulin type fabric having major pore areas of a first area in a relaxed state and major pore areas of a second area in a tensioned state which expand up to about 5.0 square millimeters on average.

* * * * *